US010487533B1

(12) United States Patent
Flaugher, Jr.

(10) Patent No.: US 10,487,533 B1
(45) Date of Patent: Nov. 26, 2019

(54) ROOF SHADE SYSTEM

(71) Applicant: Philip Flaugher, Jr., Pickens, SC (US)

(72) Inventor: Philip Flaugher, Jr., Pickens, SC (US)

( * ) Notice: Subject to any disclaimer, the term of this patent is extended or adjusted under 35 U.S.C. 154(b) by 0 days.

(21) Appl. No.: 16/047,156

(22) Filed: Jul. 27, 2018

(51) Int. Cl.
*E04H 15/60* (2006.01)
*E04G 21/32* (2006.01)
*E04H 15/58* (2006.01)

(52) U.S. Cl.
CPC ..... *E04H 15/60* (2013.01); *E04G 21/32* (2013.01); *E04H 15/58* (2013.01)

(58) Field of Classification Search
CPC ..... E04H 15/06; E04H 15/60; E04H 15/58; E04G 21/32
USPC ..... 135/88.06
See application file for complete search history.

(56) References Cited

U.S. PATENT DOCUMENTS 4,340,075 A * 7/1982 Medeiros ..... E04H 15/26 135/120.1
4,605,030 A * 8/1986 Johnson ..... E04H 6/04 135/117
5,241,977 A * 9/1993 Flores ..... B60J 11/00 135/119
5,477,876 A * 12/1995 Moss ..... E04H 15/26 135/100
5,727,583 A 3/1998 Kennedy
5,778,613 A * 7/1998 Thomson ..... E04H 15/64 135/115
5,799,680 A 9/1998 Dorflinger
5,924,832 A * 7/1999 Rice ..... E04H 12/34 135/908
7,546,844 B2 * 6/2009 Al-Mutairi ..... E04H 6/025 135/143
8,453,996 B1 * 6/2013 Papadopoli ..... A01G 9/28 256/23
9,010,348 B1 * 4/2015 Kite ..... E04H 15/08 135/88.06
9,506,268 B1 11/2016 Bright et al.
2003/0230329 A1 * 12/2003 McGarty ..... E04H 15/06 135/88.07
2006/0086470 A1 * 4/2006 Ghazali ..... B60J 11/00 160/370.21
2011/0139202 A1 6/2011 Milano, Jr. et al.

* cited by examiner

*Primary Examiner* — Noah Chandler Hawk
(74) *Attorney, Agent, or Firm* — Dority & Manning, P.A.

(57) ABSTRACT

A roof shade system includes a canopy. A plurality of canopy supports is configured to hold the canopy over a roof when the plurality of canopy supports is mounted to the roof. A shaft holder is rotatably mounted to the base plate in each of the plurality of canopy supports. Each of the plurality of canopy supports also includes a pair of elongated shafts. One of the pair of elongated shafts is mountable to the shaft holder. The other of the pair of elongated shafts is positionable on the one of the pair of elongated shafts. A crown is mountable to the other of the pair of elongated shafts. The crown is configured to support the canopy. A distance between the base plate and the crown is adjustable by sliding the other of the pair of elongated shafts on the one of the pair of elongated shafts.

16 Claims, 8 Drawing Sheets

ROOF SHADE SYSTEM

FIELD OF THE INVENTION

The present subject matter relates generally to systems for providing shade on roofs.

BACKGROUND OF THE INVENTION

Working on roofs poses challenges. Roofs are frequently exposed to direct sunlight. High temperatures resulting from such direct sunlight can make roofs difficult work environments, especially during summer months. Workers frequently limit time spent on roofs during high temperatures to avoid heat related injuries at the cost of productivity. Known systems for providing shade on roofs have drawbacks, such as being overly large and complex.

BRIEF DESCRIPTION OF THE INVENTION

Aspects and advantages of the invention will be set forth in part in the following description, or may be apparent from the description, or may be learned through practice of the invention.

In an example embodiment, a roof shade system includes a canopy. A plurality of canopy supports is configured to hold the canopy over a roof when the plurality of canopy supports is mounted to the roof. Each of the plurality of canopy supports includes a base plate. A shaft holder is rotatably mounted to the base plate. The shaft holder is rotatable relative to the base plate when the base plate is mounted to the roof. Each of the plurality of canopy supports also includes a pair of elongated shafts. One of the pair of elongated shafts is mountable to the shaft holder such that the one of the pair of elongated shafts extends away from the base plate. The other of the pair of elongated shafts is positionable on the one of the pair of elongated shafts such that the other of the pair of elongated shafts is slidable on the one of the pair of elongated shafts. A crown is mountable to the other of the pair of elongated shafts. The crown is configured to support the canopy. A distance between the base plate and the crown is adjustable by sliding the other of the pair of elongated shafts on the one of the pair of elongated shafts. The canopy may be supportable over the roof with only the plurality of canopy supports and one or more lines extending between the plurality of canopy supports. A width of the crown may be no less than three feet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
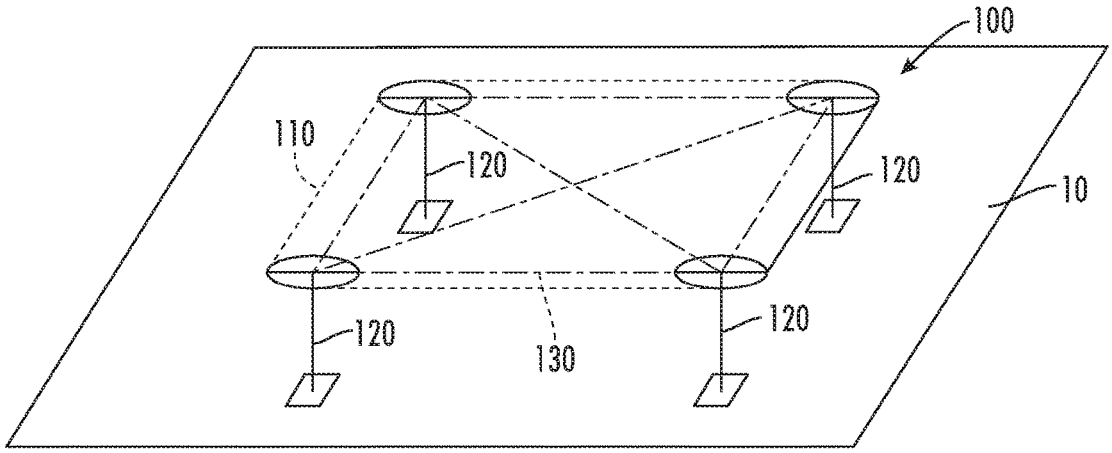
FIG. 1 is schematic view of a roof shade system according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is schematic view of a roof shade system 100 according to an example embodiment of the present subject matter. In FIG. 1, roof shade system 100 is shown positioned on a roof 10. A temperature of roof 10 below roof shade system 100 may be significantly less relative to the temperature of roof 10 outside of roof shade system 100. In such a manner, a person on roof 10 may work below roof shade system 100 in more comfort and/or in a safer manner relative to working without roof shade system 100.

Roof shade system 100 includes a canopy 110, a plurality of canopy supports 120 and one or more lines 130. Canopy supports 120 are configured to hold canopy 110 over roof 10, e.g., when canopy supports 120 are mounted to roof 10 as shown in FIG. 1. Canopy 110 may be a piece of fabric, such as knitted polyethylene, woven polypropylene, a tarpaulin, a plastic sheet, etc. Canopy 110 may provide shade below canopy 110 when canopy supports 120 hold canopy 110 over roof 10.

Canopy 110 may be sized to cover a portion of roof 10 when canopy supports 120 hold canopy 110 over roof 10 as shown in FIG. 1. In alternative example, embodiments, canopy 110 may be sized to cover the entirety of roof 10 when canopy supports 120 hold canopy 110 over roof 10. As a particular example, a length L of canopy 110 may be no less than one hundred feet (100 feet) and/or an area of canopy 110 may be no less than four hundred square feet (400 feet). The sizing of canopy 110 may be selected to provide a suitable area of shade on roof 10.

As noted above, canopy supports 120 are configured to hold canopy 110 over roof 10. In particular, canopy supports 120 may be attached to roof 10, and one or more lines 130 may be strung between canopy supports 120. For example, the one or more lines 130 may circumscribe an outer perimeter formed by canopy supports 120 as well as crossing between canopy supports 120 within the outer perimeter as shown in FIG. 1. With canopy supports 120 attached to roof 10 and the one or more lines 130 extended between canopy supports 120, canopy 110 may be suspended on canopy supports 120 and the one or more lines 130 over roof 10. The one or more lines 130 may be a suitable rope, cable, cord, etc.

Roof shade system 100 may have a suitable number of canopy supports 120. For example, roof shade system 100 may have two, three, four, five, six or more canopy supports 120. The number of canopy supports 120 may be selected to provide proper support for canopy 110 and/or the one or more lines 130, e.g., without excessive sagging of canopy 110. By providing a suitable number of canopy supports 120 and/or the one or more lines 130, canopy 110 may be supported over roof 10 with only canopy supports 120 and/or the one or more lines 130. Thus, e.g., roof shade system 100 may not require directly tying the one or more lines 130 to ground and/or roof 10.

Figure 2:
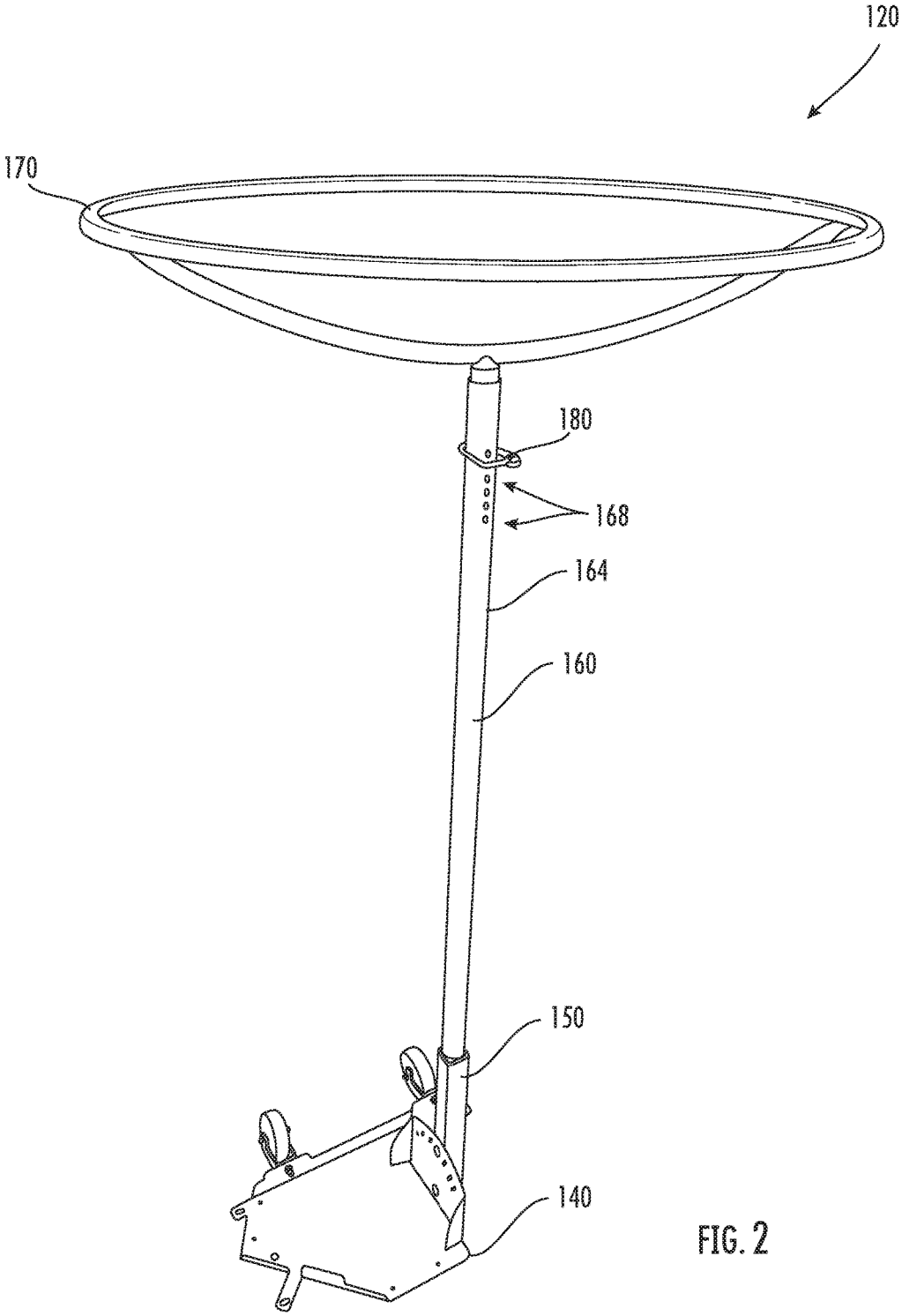
FIG. 2 is a perspective view of a canopy support of the example roof shade system of FIG. 1.

Turning to FIG. 2, one of canopy supports 120 is shown. It will be understood that each of canopy supports 120 may be constructed in the same or similar manner to that shown in FIG. 2. Thus, each of canopy supports 120 includes a base plate 140, a shaft holder 150, a pair of elongated shafts 160 and a crown 170. Base plate 140 may be mounted (e.g., fastened) to roof 10. Shaft holder 150 is rotatably mounted to base plate 140. Thus, shaft holder 150 is rotatable relative to base plate 140 when base plate 140 is mounted to roof 10.

Elongated shafts 160 may be mounted to shaft holder 150 such that elongated shafts 160 are also rotatable relative to base plate 140. By rotating relative to base plate 140, an orientation of shaft holder 150 (and thus elongated shafts 160) relative to roof 10 may be selected. Thus, canopy supports 120 may be mounted to roofs with various pitches.

A first shaft 162 (shown in FIG. 4) of elongated shafts 160 is mountable to shaft holder 150. First shaft 162 may extend away from base plate 140, e.g., such that a proximal end of first shaft 162 is mounted to and/or received within shaft holder 150 and a distal end of first shaft 162 is spaced from base plate 140 and shaft holder 150. A second shaft 164 of elongated shafts 160 is positionable on first shaft 162. In particular, second shaft 164 may be slidable and/or extendable on first shaft 162, as discussed in greater detail below.

Figure 3:
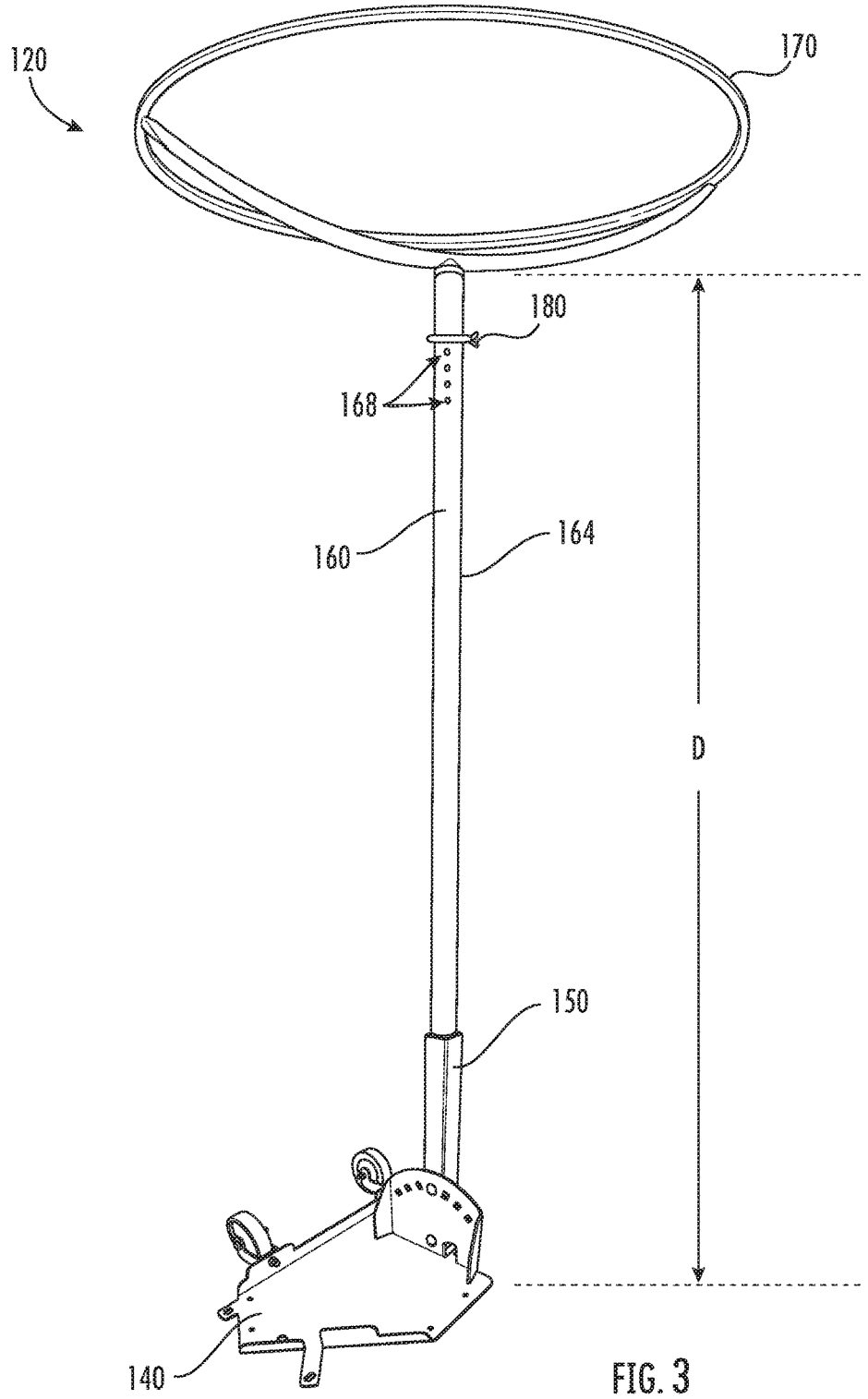
FIG. 3 is a side elevation view of the canopy support of FIG. 2 with a pair of elongated shafts shown in a retracted configuration.
Figure 4:
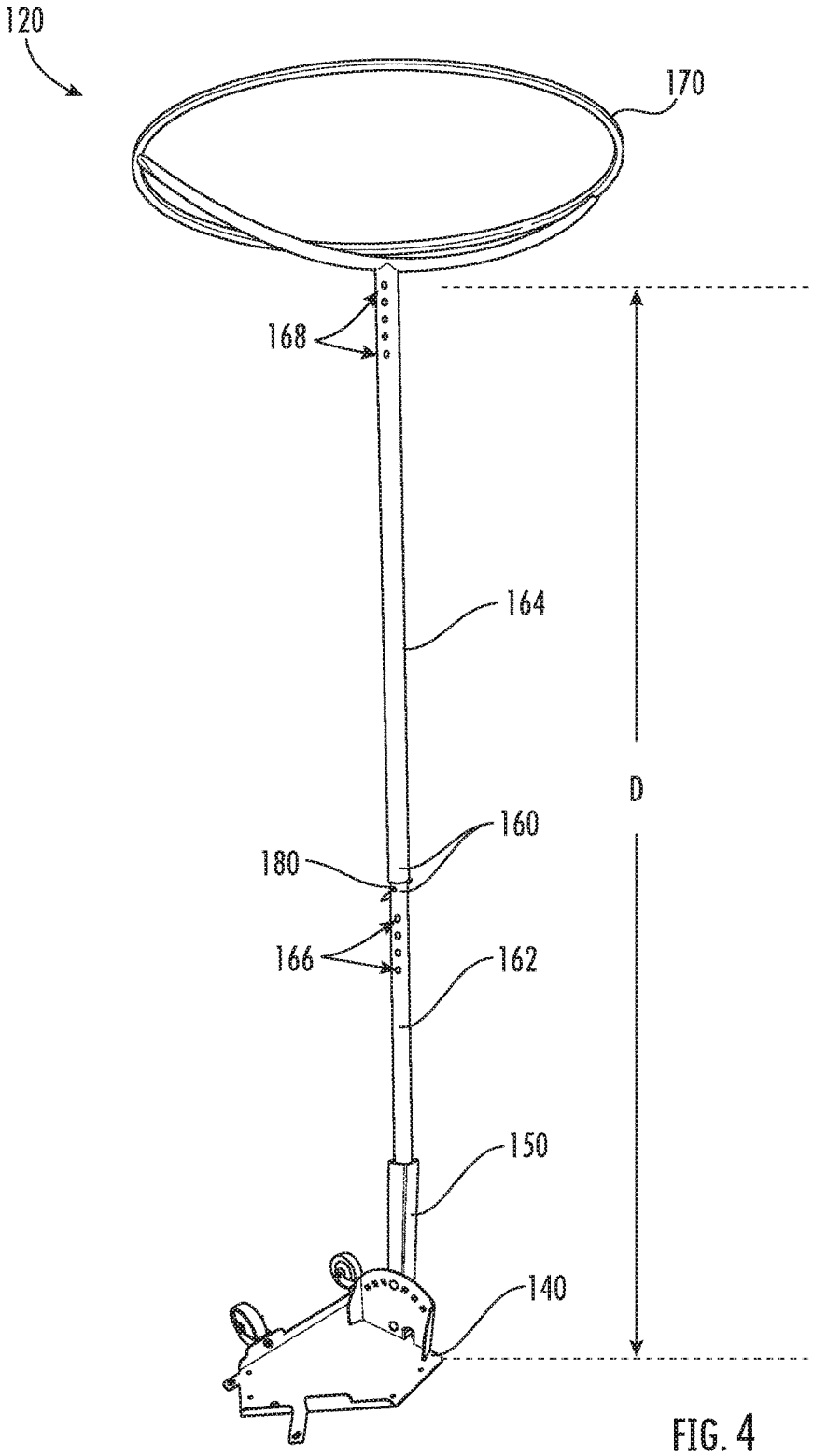
FIG. 4 is a side elevation view of the canopy support of FIG. 2 with the pair of elongated shafts shown in an extended configuration.

Crown 170 is mountable to elongated shafts 160, e.g., to second shaft 164. Crown 170 is configured to support canopy 110. Thus, canopy 110 may rest and/or be tied to crown 170. As shown in FIGS. 3 and 4, a distance D between base plate 140 and crown 170 is adjustable by sliding and/or extending second shaft 164 on first shaft 162. In FIG. 3, second shaft 164 is shown retracted on first shaft 162. Conversely, second shaft 164 is shown extended on first shaft 162 in FIG. 4. Thus, the distance D between base plate 140 and crown 170 is smaller in FIG. 3 relative to FIG. 4. By extending second shaft 164 on first shaft 162 from the configuration shown in FIG. 3 to the configuration 4, the distance D between base plate 140 and crown 170 may be increased, and canopy 110 on crown 170 may be lifted further above roof 10.

In certain example embodiments, second shaft 164 is received on first shaft 162. Thus, e.g., an inner diameter of second shaft 164 may be complementary to an outer diameter of first shaft 162. In such a manner, second shaft 164 may be slidable on first shaft 162. When second shaft 164 is received on first shaft 162, a user may simply grasp second shaft 164 at any location on second shaft 164 and lift upwardly to extend second shaft 164 on first shaft 162.

Each of canopy supports 120 may also include a locking pin 180. First shaft 162 defines one or more through holes 166. Locking pin 180 is extendable through first shaft 162 at the one or more through holes 166. With locking pin 180 extended through the one or more through holes 166, locking pin 180 may prevent sliding of second shaft 164 on first shaft 162, e.g., from the extended configuration (FIG. 4) to the retracted configuration (FIG. 3). Second shaft 164 may also define one or more through holes 168. Locking pin 180 is extendable through second shaft 164 at the one or more through holes 168. With locking pin 180 extended through the one or more through holes 166 of first shaft 162 and the one or more through holes 168 of second shaft 164, locking pin 180 may prevent sliding of second shaft 164 on first shaft 162, e.g., from the retracted configuration (FIG. 3) to the extended configuration (FIG. 4). Thus, locking pin 180 may fix a position of second shaft 164 on first shaft 162.

Figure 5:
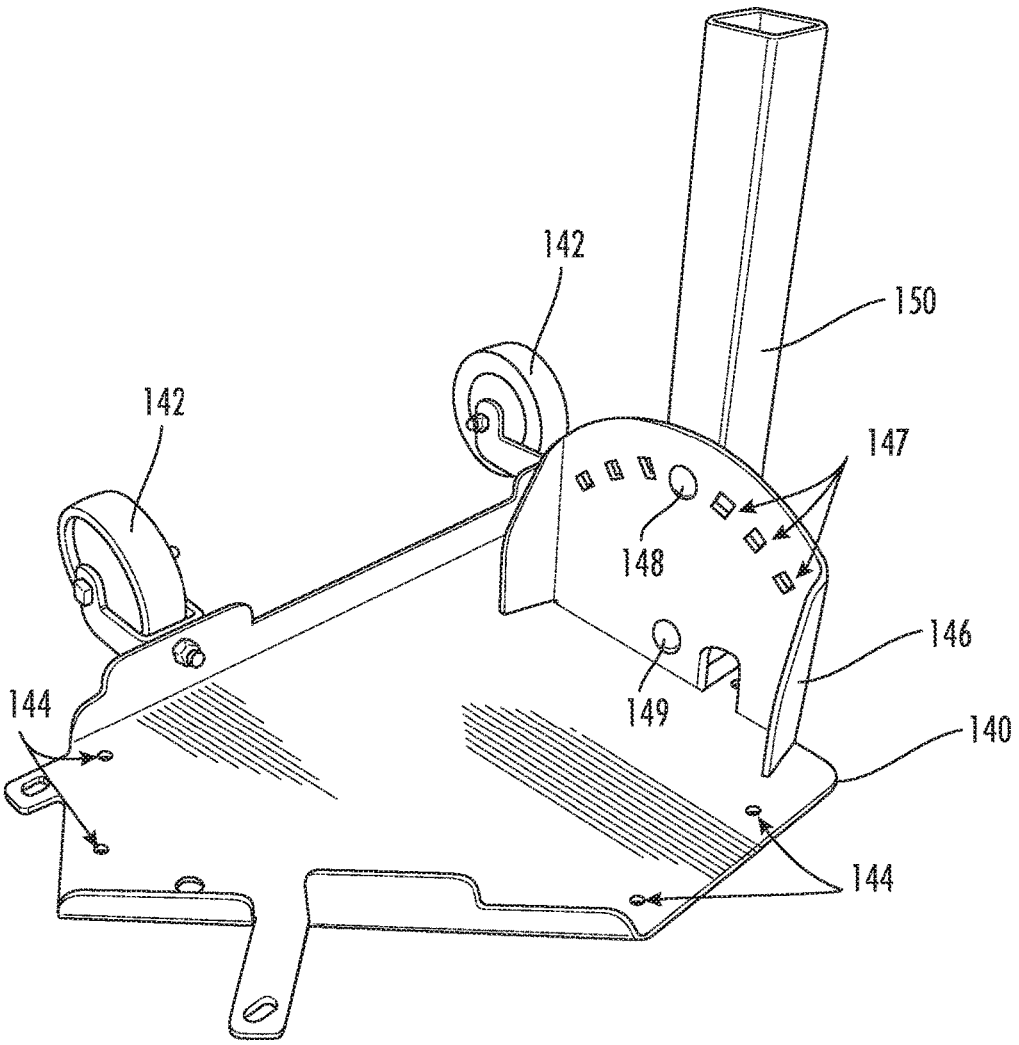
FIG. 5 is a perspective view of a base plate and a shaft holder of the canopy support of FIG. 2 with the shaft holder shown in a first orientation.
Figure 6:
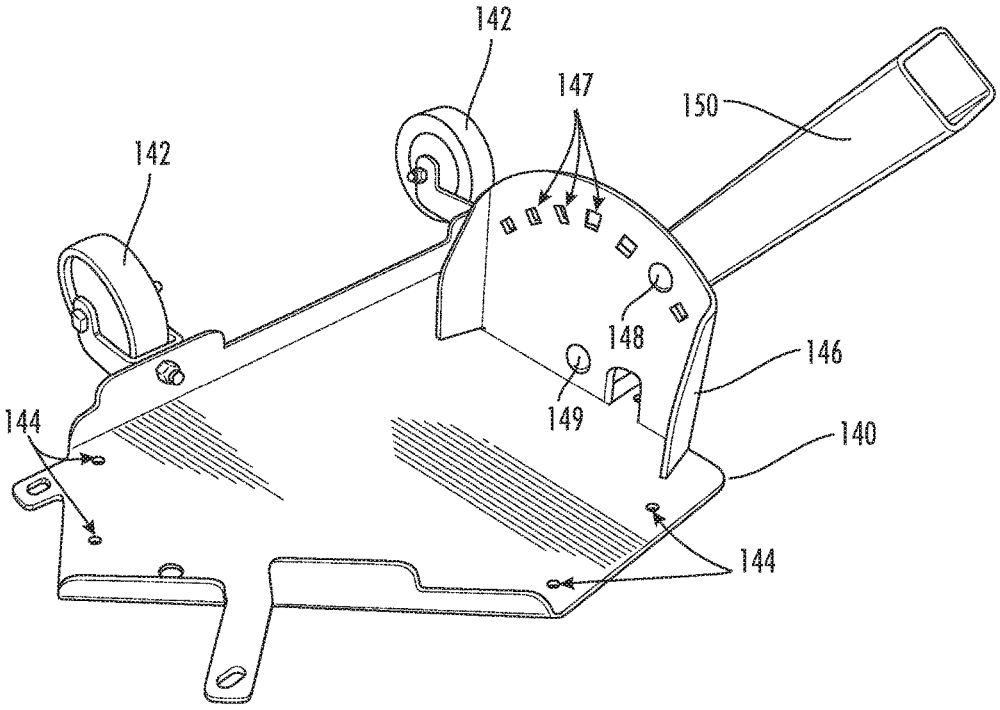
FIG. 6 is another perspective view of the base plate and the shaft holder of the canopy support of FIG. 2 with the shaft holder shown in a second orientation.

Turning to FIG. 5, each of canopy supports 120 may include a pair of wheels 142 mounted to base plate 140. Wheels 142 may assist with transporting canopy support 120 by allowing a user to roll (e.g., rather than drag) canopy support 120 across roof 10 or another surface. As shown in FIG. 5, base plate 140 may define a plurality of holes 144. Fasteners, such as screws, may be extended through holes 144 into roof 10 in order to mount base plate 140 to roof 10. As an example, two or more of holes 144 may be laterally spaced by about sixteen inches (16 in).

Base plate 140 may also include a perforated panel 146 and a locking bolt 148. Shaft holder 150 may be rotatably mounted to perforated panel 146. For example, a shaft 149 may extend through shaft holder 150 and perforated panel 146, and shaft holder 150 may be rotatable relative to perforated panel 146 on shaft 149. Locking bolt 148 is extendable through perforated panel 146 and shaft holder 150 to fix an orientation of shaft holder 150 on perforated panel 146. For example, locking bolt 148 may be removed from shaft holder 150 to allow shaft holder 150 to rotate relative to base plate 140. A particular orientation of shaft holder 150 on perforated panel 146 may be selected by extending locking bolt 148 through a respective one of the holes 147 in perforated panel 146.

Figure 7:
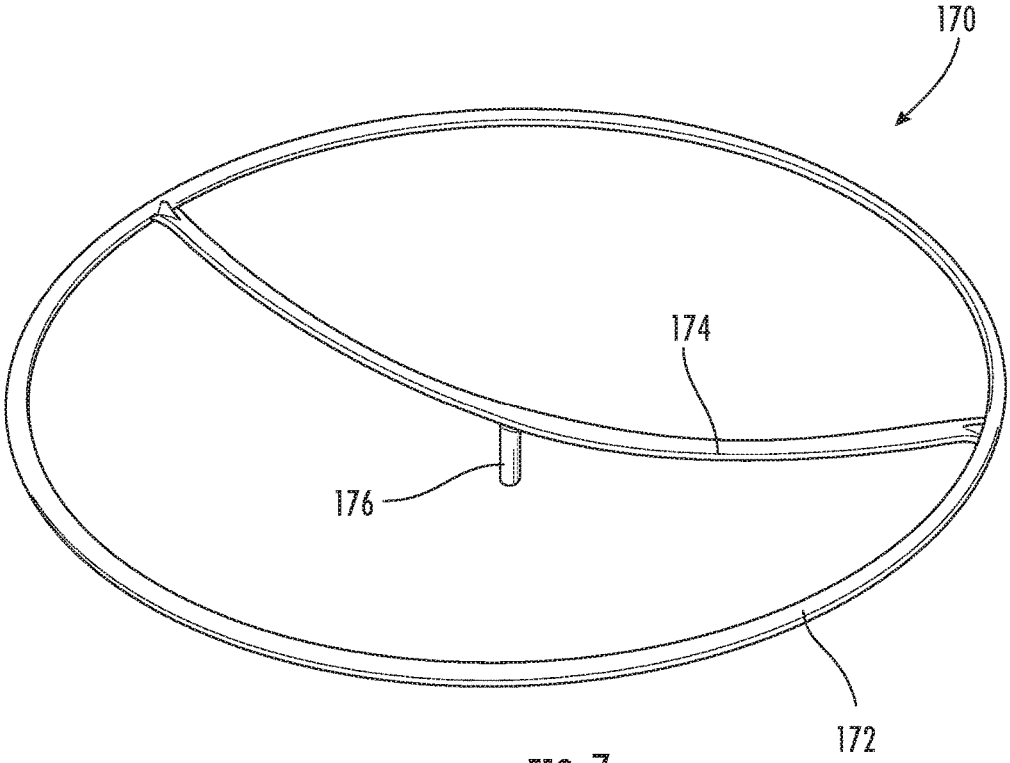
FIG. 7 is a perspective view of a crown of the canopy support of FIG. 2.

Turning to FIG. 7, crown 170 of each canopy support 120 may have an annular frame 172, a crossbar 174 and a central post 176. Crossbar 174 connects annular frame 172 to central post 176. Central post 176 is mountable to second shaft 164. Annular frame 172 may be sized to support canopy 110. For example, a diameter of annular frame 172 may be no less than three feet (3 ft). The circular shape and/or size of annular frame 172 may assist with allowing canopy 110 to slide over annular frame 172 without snagging, e.g., during set up of roof shade system 100. In addition, excess canopy 110 may be looped over annular frame 172 and/or crossbar 174 to assist with mounting canopy 110 to canopy supports 120 on crowns 170.

Figure 8:
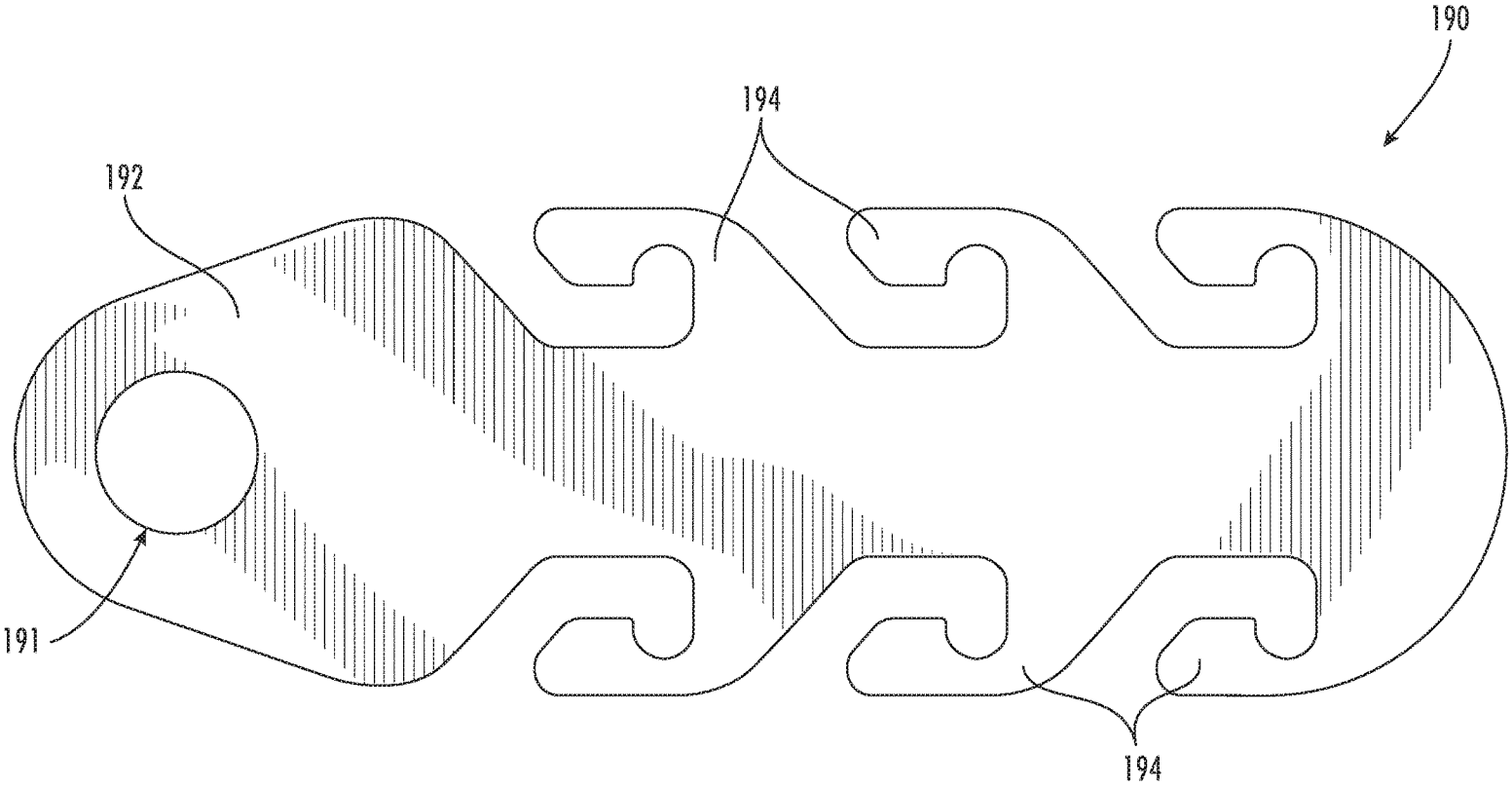
FIG. 8 is a plan view of a line tie off of the canopy support of FIG. 2.

Each canopy support 120 may also include a line tie off 190 as shown in FIG. 8. Line tie off 190 may be mounted to second shaft 164 and/or central post 176 of crown 170. For example, second shaft 164 and/or central post 176 of crown 170 may extend through a hole 191 in line tie off 190 to mount line tie off 190 to second shaft 164 and/or central post 176 of crown 170.

One or more lines 130 may be mounted or tied of at line tie off 190 in order to couple the one or more lines 130 to canopy support 120. Line tie off 190 may include a body 192 with a plurality of spaced hooks 194, e.g., on both lateral sides of body 192. The one or more lines 130 may be received between an arm of spaced hooks 194 and body 192, and interference between the one or more lines 130 and body 192 at spaced hooks 194 may prevent retraction of the one or more lines 130 through the spaced hooks 194.

To install roof shade system 100 on roof 10, canopy supports 120 may first be distributed in a suitable pattern on roof 10. Base plates 140 of canopy supports 120 may then be fastened to roof 10 in order to mount canopy supports 120 to roof 10. With canopy supports 120 mounted to roof 10, one or more lines 130 may be extended between the canopy supports 120 and secured to canopy supports with line tie offs 190. Next, canopy 110 is positioned on canopy supports 120 and one or more lines 130 over roof 10. The ends of canopy 110 may be looped over crowns 170 to assist with securing canopy 110 to canopy supports 120. With canopy positioned on canopy supports 120 and the one or more lines 130, elongated shafts 160 may be shifted to the extended configuration to lift canopy 110 to a suitable height over roof 10 and locking pin 180 may secure elongated shafts 160 in the extended configuration. In such a manner, roof shade system 100 may be installed on roof 10.

Roof shade system 100 provides numerous benefits over known systems. For example, roof shade system 100 may be light comparted to known system. In addition, roof shade system 100 may be installed on roof 10 more quickly than known systems. In particular, by providing canopy supports 120 and/or one or more lines 130, canopy 110 may be supported over roof 10 without requiring time consuming tying of canopy 110 to ground or directly to roof 10. Further, with base plate 140 being rotatable relative to shaft holder 150, the orientation of elongated shafts 160 and thus crown 170 relative to roof 10 may be adjusted to conform to the pitch of roof 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A roof shade system, comprising:
a canopy;
a plurality of canopy supports configured to hold the canopy over a roof when the plurality of canopy supports are mounted to the roof, each of the plurality of canopy supports comprising
a base plate;
a shaft holder rotatably mounted to the base plate, the shaft holder rotatable relative to the base plate when the base plate is mounted to the roof;
a pair of elongated shafts, one of the pair of elongated shafts mountable to the shaft holder such that the one of the pair of elongated shafts extends away from the base plate, the other of the pair of elongated shafts positionable on the one of the pair of elongated shafts such that the other of the pair of elongated shafts is slidable on the one of the pair of elongated shafts; and
a crown mountable to the other of the pair of elongated shafts, the crown configured to support the canopy, the crown having an annular frame, a crossbar and a central post, the crossbar connecting the annular frame to the central post, the central post mountable to the other of the pair of elongated shafts,
wherein a distance between the base plate and the crown is adjustable by sliding the other of the pair of elongated shafts on the one of the pair of elongated shafts.

2. The roof shade system of claim 1, further comprising one or more lines extendable between the plurality of canopy supports, the one or more lines configured to hold the canopy over the roof when the plurality of canopy supports are mounted to the roof and the one or more lines extend between the plurality of canopy supports.

3. The roof shade system of claim 2, wherein each of the plurality of canopy supports further comprises a line tie off mounted to the one of the pair of elongated shafts or the crown, the one or more lines mountable at the line tie off to the one of the pair of elongated shafts or the crown.

4. The roof shade system of claim 3, wherein the line tie off of each of the plurality of canopy supports comprises a body with a plurality of spaced hooks.

5. The roof shade system of claim 1, wherein each of the plurality of canopy supports further comprises a pair of wheels mounted to the base plate.

6. The roof shade system of claim 1, wherein the base plate of each of the plurality of canopy supports defines a plurality of holes, fasteners extendable through the plurality of holes into the roof in order to mount the base plate to the roof.

7. The roof shade system of claim 6, wherein two or more of the plurality of holes are laterally spaced by about sixteen inches.

8. The roof shade system of claim 1, wherein the base plate of each of the plurality of canopy supports has a perforated panel and a locking bolt, the shaft holder rotatable mounted to the perforated panel, the locking bolt extendable through the perforated panel and the shaft holder to fix an orientation of the shaft holder on the perforated panel.

9. The roof shade system of claim 1, wherein each of the plurality of canopy supports further comprises a locking pin, the one of the pair of elongated shafts defining one or more through holes, the locking pin extendable through the one of the pair of elongated shafts at the one or more through holes of the one of the pair of elongated shafts in order to fix a position of the other of the pair of elongated shafts on the one of the pair of elongated shafts.

10. The roof shade system of claim 1, wherein a diameter of the annular frame is no less than three feet.

11. The roof shade system of claim 1, wherein an inner diameter of the other of the pair of elongated shafts is complementary to an outer diameter of the one of the pair of elongated shafts in each of the plurality of canopy supports.

12. The roof shade system of claim 1, wherein a length of the canopy is no less than one hundred feet.

13. The roof shade system of claim 1, wherein the plurality of canopy supports is no less than four canopy supports.

14. The roof shade system of claim 1, wherein the canopy is supportable over the roof with only the plurality of canopy supports and one or more lines extending between the plurality of canopy supports.

15. A roof shade system, comprising:
a canopy;
a plurality of canopy supports configured to hold the canopy over a roof when the plurality of canopy supports are mounted to the roof, each of the plurality of canopy supports comprising
a base plate;

a shaft holder rotatably mounted to the base plate, the shall holder rotatable relative to the base plate when the base plate is mounted to the roof;

a pair of elongated shafts, one of the pair of elongated shafts mountable to the shaft holder such that the one of the pair of elongated shafts extends away from the base plate, the other of the pair of elongated shafts positionable on the one of the pair of elongated shafts such that the other of the pair of elongated shafts is extendable from the one of the pair of elongated shafts;

a crown mountable to the other of the pair of elongated shafts, the crown configured to support the canopy; and a line tie off mounted to the one of the pair of elongated shafts or the crown, the line tie off comprising a body with a plurality of spaced hooks, wherein a distance between the base plate and the crown is adjustable by extending the other of the pair of elongated shafts on the one of the pair of elongated shafts, wherein the canopy is supportable over the roof with only the plurality of canopy supports and one or more lines extending between the plurality of canopy supports, and wherein the one or more lines are configured to hold the canopy over the roof when the plurality of canopy supports are mounted to the roof and the one or more lines extend between the plurality of canopy supports, and the one or more lines are mountable at the line tie off to the one of the pair of elongated shafts or the crown.

16. A roof shade system, comprising:

a canopy;

a plurality of canopy supports configured to hold the canopy over a roof when the plurality of canopy supports are mounted to the roof, each of the plurality of canopy supports comprising a base plate;

a shaft holder rotatably mounted to the base plate, the shaft holder rotatable relative to the base plate when the base plate is mounted to the roof;

a pair of elongated shafts, one of the pair of elongated shafts mountable to the shaft holder such that the one of the pair of elongated shafts extends away from the base plate, the other of the pair of elongated shafts positionable on the one of the pair of elongated shafts such that the other of the pair of elongated shafts is extendable from the one of the pair of elongated shafts; and a crown mountable to the other of the pair of elongated shafts, the crown configured to support the canopy, a width of the crown being no less than three feet, wherein a distance between the base plate and the crown is adjustable by extending the other of the pair of elongated shafts on the one of the pair of elongated shafts.

* * * * *